United States Patent [19]

Curtis, Jr.

[11] 4,154,172

[45] May 15, 1979

[54] DECK MEANS FOR A RAILROAD CAR

[75] Inventor: Albert B. Curtis, Jr., Lake Oswego, Oreg.

[73] Assignee: Carlock, Inc., Oreg.

[21] Appl. No.: 639,242

[22] Filed: Dec. 9, 1975

[51] Int. Cl.[2] ..... B61D 17/10

[52] U.S. Cl. ..... 105/422; 52/483

[58] Field of Search ..... 105/422, 375; 114/76; 52/483, 489

[56] References Cited

U.S. PATENT DOCUMENTS

| | | | |
|---|---|---|---|
| 2,066,005 | 12/1936 | Jenkins | 52/489 X |
| 3,528,376 | 9/1970 | Curtis | 105/422 |

FOREIGN PATENT DOCUMENTS

| | | | |
|---|---|---|---|
| 16930 of | 12/1887 | United Kingdom | 52/489 |

*Primary Examiner*—Francis S. Huser

*Assistant Examiner*—George F. Abraham

*Attorney, Agent, or Firm*—John R. Walker, III

[57] ABSTRACT

A system of attaching floor decking to a railroad car of the type having an open floor structure of flanged beam members. A plurality of plank members are positioned upon the flanged beam members. Each plank member is provided with a longitudinal groove along each longitudinal edge thereof. A plurality of fastening members attach the plank members to the beam members. Each fastening member includes a platelike body portion having a slot therein for grippingly engaging a flange of one of the beam members and includes first and second tongue portions fixedly attached to and extending from opposite sides of the body portion thereof for extending into the longitudinal grooves of two adjacent plant members thereby attaching the two adjacent plank members to the beam member which the fastening member grippingly engages.

3 Claims, 6 Drawing Figures

DECK MEANS FOR A RAILROAD CAR

BACKGROUND OF THE INVENTION

1. Field of the Present Invention

This invention relates generally to a floor deck for a railroad car of the type having an open floor structure of flanged beam members and more specifically to means for mounting such a floor deck to the floor structure of the railroad car.

2. Description of the Prior Art

One typical method of fastening floor decking to the open floor structure of a railroad car is simply by bolting the floor decking to the flanged beam members of the floor structure (see, for example, Osborn, U.S. Pat. No. 2,587,754 and Sale, U.S. Pat. No. 2,852,815). Such a method is time-consuming and the bolts have a tendency to loosen due to vibrations in the railroad car and for these reasons and others has not prooved to be entirely satisfactory. Attempts have been made to overcome the problems and disadvantages associated with the bolt method of fastening floor decking to the open floor structure of a railroad car. Curtis (U.S. Pat. No. 3,528,376) discloses a system of using a clip-like tie member having a first end adapted to grippingly engage the tongue portion of typical tongue and groove tongue decking and having a second end adapted to be fixedly attached to a beam member of the open floor structure of the railroad car. The present invention is an improvement over such a system.

SUMMARY OF THE INVENTION

The present invention is directed towards overcoming the problems and disadvantages of and improving prior systems of attaching floor decking to a railroad car of the type having an open floor structure of flanged beams. The concept of the present invention is to provide a fastening member having a platelike body portion with a slot therein corresponding substantially with a flange of one of the flanged beam members for allowing the fastening member to grippingly engage one of the flanged beam members and having first and second tongue portions fixedly attached to and extending outwardly from opposite sides of the body portion thereof for grippingly engaging two adjacent plank members to attach the two adjacent plank members to the flanged beam member which the fastening member engages. The plank members are preferably constructed of laminated wood and preferably include a longitudinal groove portion provided in each longitudinal edge thereof for coacting with the tongue portions of the fastening members. The body portion of each of the fastening members preferably includes an aperture therethrough for allowing a nail or the like to pass therethrough to fixedly attach the fastening member to one of the plank members.

DESCRIPTION OF THE PREFERRED EMBODIMENT

Figure 1:
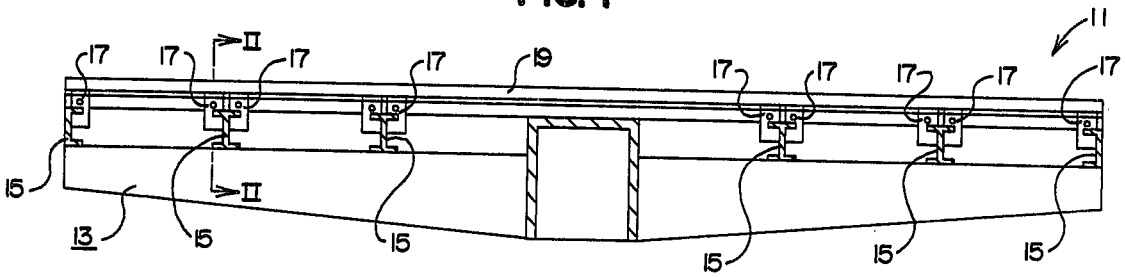
FIG. 1 is a transverse vertical sectional view through the floor structure of a flatbed railroad car having the deck means of the present invention.

The deck means 11 of the present invention is for use with a railroad car, such as the flatbed railroad car a part of which is shown at 13 in FIG. 1, of the type having an open floor structure of flanged beam members 15. The deck means 11 includes at least one fastening member 17 for attaching plank members 19 to the flanged beam members 15 of the railroad car 13. Preferably, the deck means 11 includes a plurality of fastening members 17 and a plurality of plank members 19.

Figure 3:
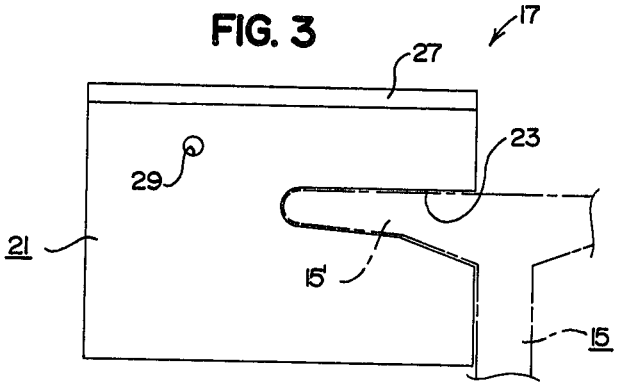
FIG. 3 is a side elevational view of a fastening member of the deck means of the present invention showing a portion of a flanged beam member in phantom lines.
Figure 4:
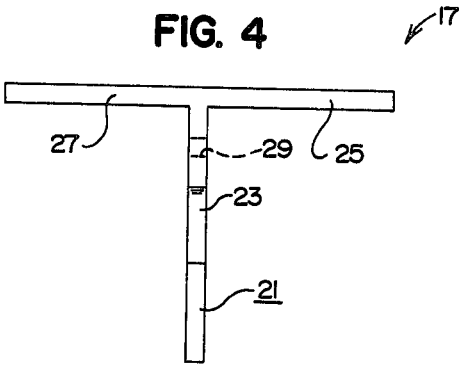
FIG. 4 is an end elevational view of a fastening member of the deck means of the present invention.
Figure 5:
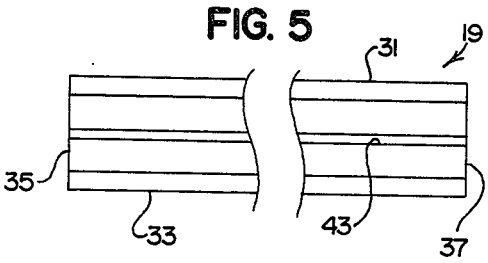
FIG. 5 is a side elevational view of a plank member of the deck means of the present invention.
Figure 6:
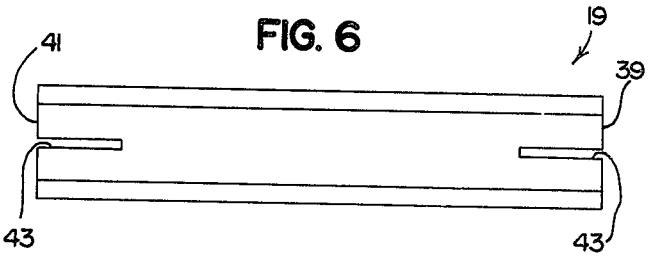
FIG. 6 is an end elevational view of a plank member of the deck means of the present invention.

Each of the plurality of fastening members 17 includes a vertical platelike body portion 21 having a slot 23 therein corresponding substantially with a flange 15' of one of the flanged beam members 15 (see FIG. 3). The slot 23 allows the fastening member 17 to grippingly engage one of the beam members 15. In addition, each of the fastening members 17 includes first and second tongue portions 25, 27 fixedly attached to and extending outwardly from opposite sides of the body portion 21. The first and second tongue portions 25, 27 are preferably fixedly attached to the body portion 21 adjacent the top edge thereof. The body portion 21 of each of the fastening members 17 preferably includes an aperture 29 therethrough for reasons which will hereinafter become apparent. Each of the fastening members 17 is preferably constructed of metal such as $\frac{1}{8}''$ steel plate in any manner apparent to those skilled in the art.

Each of the plank members 19 includes a top 31, a bottom 33, first and second ends 35, 37 and first and second longitudinal sides 39, 41. Each of the plank members 19 preferably includes a longitudinal groove portion 43 in the first and second longitudinal sides 39, 41 thereof. The first and second tongue portions 25, 27 of each fastening member 17 corresponds substantially with the longitudinal groove portions 43 of the plank members 19 for allowing the fastening members 19 to grippingly engage two adjacent ones of the plurality of plank members 19 thereby attaching the two adjacent plank members 19 to the beam member 15 which the fastening member 17 grippingly engages. It should be noted that each plank member 19 is preferably formed of laminated wood in any manner well known to those skilled in the art.

Figure 2:
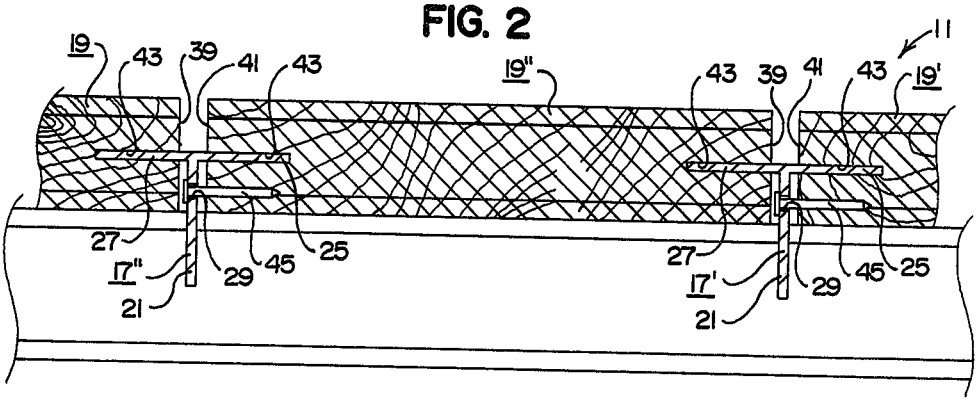
FIG. 2 is a sectional view as taken from line II—II of FIG. 1 showing the deck means of the present invention attached to a flanged beam member of the floor structure of a railroad car.

The attachment of floor decking to the open floor structure of the railroad car 13 with the deck means 11 of the present invention will now be explained with reference FIGS. 1, 2 and 3 of the drawings. First, assuming the floor decking is being applied from right to left as viewed in FIG. 2, a plank member 19' is positioned upon the beam members 15 of the floor structure. Next, one or more fastening members 17' are attached to the flanged beam members 15 with the slot 23 thereof grippingly engaging the flange 15' of each beam member 15 and with the first tongue portion 25 thereof being inserted into the groove portion 43 of the second longitudinal side 41 of the plank member 19' thereby allowing the fastening members 17' to grippingly engage the plank member 19' to attach the plank member 19' to the beam members 15 which the fastening members 17' grippingly engage. Means such as a nail 45 or the like is then passed through the aperture 29 in the body portion 21 of the fastening member 17' and into the first plank member 19' to fixedly attach the fastening member 17' and the first plank member 19' together. Next, a second plank member 19'' is positioned upon the flanged beam members 15 with the grooved portion 43 of the first longitudinal side 39 thereof receiving the second tongue portion 27 of the fastening members 17 to allow the fastening members 17' to grippingly engage the plank member 19'' and thereby attach the plank member 19'' to the beam members 15 which the fastening members 17' grippingly engage. Next, a second fastening member 17'' is attached to the beam members 15 with the slot 23 thereof grippingly engaging the flange 15' of the beam members 15 and with the first tongue portion 25 being received in the grooved portion 33 of the first longitudinal side 39 of the plank member 19'' thereby allowing the fastening member 17'' to grippingly engage the plank member 19'' and to attach the plank member 19'' to the beam members 15 which the fastening members 17'' grippingly engage. A nail 45 or the like is then passed through the aperture 29 in the body portion 21 of the fastening member 17'' and into the second plank member 19'' to fixedly attach the fastening member 17'' and the second plank member 19'' together. This process is repeated until the desired portion of the open floor structure of the railroad car 13 is decked. It should be noted that the plank members 19 may be applied to the floor structure of the railroad car 13 with spaces provided therebetween as shown in FIG. 2 of the drawings. However, if it is desired to provide the railroad car 13 with floor decking which provides a continuous, uninterrupted surface, the plank members 19 may be formed with the portions of the first and second longitudinal sides 39, 41 thereof that are above the grooved portions 43 thereof extending outwardly from the bottom portions thereof so that when the plurality of plank members 19 are attached to the beam members 15 by way of the fastening members 17, the top portions of the first and second longitudinal sides 39, 41 abut each other.

Although the invention has been described and illustrated with respect to a preferred embodiment thereof, it is not to be so limited since changes and modifications may be made therein which are within the full intended scope of the invention.

I claim:

1. The combination with a railroad car of the type having an open floor structure of flanged beam members of deck means, said deck means comprising:

(a) a plurality of plank members positioned upon the flanged beam members with the longitudinal sides of each plank member being spaced away from the longitudinal sides of each adjacent plank member, each of said plank members having a longitudinal groove portion provided in each longitudinal side thereof; and (b) a plurality of fastening members attached to the flanged beam members, each of said plurality of fastening members including a platelike body portion having a slot therein corresponding substantially with a flange of one of the flanged beam members for allowing said fastening member to grippingly engage one of the flanged beam members, said slot having a substantially horizontal upper edge and having a downwardly sloping lower edge, said downwardly sloping lower edge having first and second portions, said first portion of said downwardly sloping lower edge having a greater slope than said second portion, each of said plurality of fastening members including first and second tongue portions fixedly attached to and extending outwardly from opposite sides of said body portion thereof into said longitudinal groove portions of said plurality of plank members and grippingly engaging two adjacent ones of said plurality of plank members thereby attaching said two adjacent ones of said plurality of plank members to the beam member which said fastening member grippingly engages, each of said plurality of fastening members including means for allowing said platelike body portion of said fastening members to be fixedly attached to one of said plurality of plank members.

2. The combination of claim 1 in which said first and second tongue portions of each of said plurality of fastening members are fixedly attached to said body portion of each of said plurality of fastening members adjacent the top edge thereof.

3. The combination of claim 2 in which said each of said means for allowing said platelike body portion of said fastening members to be fixedly attached to one of said plurality of plank members includes an aperture through said platelike body portion for allowing a nail to extend therethrough to fixedly attach each of said plurality of fastening members to one of said plurality of plank members.

* * * * *